United States Patent [19]

Gerber

[11] Patent Number: 4,463,639

[45] Date of Patent: Aug. 7, 1984

[54] FLUID JET RECEIVER POSITIONER

[75] Inventor: Heinz J. Gerber, West Hartford, Conn.

[73] Assignee: Gerber Garment Technology, Inc., South Windsor, Conn.

[21] Appl. No.: 390,919

[22] Filed: Jun. 22, 1982

[51] Int. Cl.[3] ..... B26F 3/00

[52] U.S. Cl. ..... 83/71; 83/177; 83/925 CC

[58] Field of Search ..... 83/177, 925 CC, 53, 83/71; 219/121 PC, 121 LG, 121 EH

[56] References Cited

U.S. PATENT DOCUMENTS

| | | | |
|---|---|---|---|
| 3,730,040 | 5/1973 | Chadwick et al. | 83/177 |
| 3,978,748 | 9/1976 | Leslie et al. | 83/177 |
| 4,116,097 | 9/1978 | Graham et al. | 83/177 |
| 4,137,804 | 2/1979 | Gerber et al. | 83/177 |

*Primary Examiner*—James M. Meister
*Assistant Examiner*—J. L. Knoble
*Attorney, Agent, or Firm*—McCormick, Paulding and Huber

[57] ABSTRACT

A cutting machine utilizing a movable nozzle for producing a high velocity fluid jet for cutting and a movable receiver for dissipating the cutting jet after it passes through sheet material in a cutting operation is provided with two mechanically independent carriages on which the nozzle and receiver are separately mounted. The cutting machine includes controls operatively connected with the nozzle and receiver moving mechanism for coordinating the movement of the nozzle and receiver to maintain the receiver in constant registration with the cutting jet exiting the sheet material.

6 Claims, 4 Drawing Figures

FLUID JET RECEIVER POSITIONER

BACKGROUND OF THE INVENTION

The present invention relates generally to the field of cutting and relates more particularly to an apparatus for cutting sheet materials such as limp fabrics, plastics, paper and similar products by means of high velocity fluid cutting jets.

The use of a high velocity fluid cutting jet for cutting materials such as fabrics, wood and other products has been known for some time. The cutting jet is usually produced by forcing water in a continuous stream through a nozzle at very high pressures ranging between 10,000 psi and 100,000 psi. The jet is oriented with its axis generally perpendicular to the surface of the material to be cut, and the cutting operation is effected by the jet as the nozzle is moved relative to the material surface. The energy associated with the jet of fluid, which exits the nozzle between 1,000 and 3,000 fps, may only be partially dissipated by the material in the path of the jet stream. Some means is generally needed, therefore, to dissipate the unused energy of the fluid stream after the jet passes through the material.

A fluid jet receiver capable of dissipating the energy of the jet in a cutting machine is described in U.S. Pat. No. 4,137,804, having the same assignee as the present invention. In this referenced patent, the receiver is in the form of a vortex chamber positioned on the side of the material opposite the fluid jet nozzle with the inlet of the receiver opening toward the nozzle. The carriage which supports the nozzle also supports the receiver to assure that the inlet of the receiver is in constant alignment with the axis of the fluid jet as the jet exits the nozzle while the nozzle moves relative to the sheet material.

As the cutting jet is dissipated over the thickness of the material, the jet experiences a high rate of deceleration. As a result of the high rate of deceleration, the point at which the jet exits the material may lag considerably behind the point at which the jet enters the material while the jet is moved relative to the sheet material. This lag may cause the receiver, whose inlet remains in alignment with the nozzle, to fail to catch the exiting jet stream. Of course this problem could be substantially eliminated by moving the nozzle at a slow rate of speed relative to the material, but this solution may substantially increase the amount of time, and therefore the cost, necessary to perform a cutting operation. The problem may also be eliminated by providing a receiver whose inlet is large relative to the size, or cross section, of the cutting jet, but this solution increases the likelihood that jet backsplatter resulting from the jet striking against the interior of the receiver will disperse the jet fluid against the material, and in the cutting apparatuses that require the receiver to provide partial support for the material, a relatively large receiver inlet would allow the material to sag or droop into the inlet and thereby promote the misalignment of the cutting jet and the desired cutting path in the bottom layers of the material.

It is, accordingly, a general object of the present invention to provide a sheet material cutting apparatus utilizing a fluid jet and a fluid jet receiver which circumvent the aforementioned problem associated with fluid jet lag with no reduction in speed of the nozzle relative to the material nor increase in size of the receiver inlet.

SUMMARY OF THE INVENTION

The present invention resides in a cutting apparatus including a fluid jet nozzle for directing a high velocity fluid cutting jet along an axis toward a support surface on which sheet material is spread and a fluid jet receiver for dissipating the unused energy of the cutting jet after the jet exits the material.

The apparatus includes a cutting table having a support bed upon which sheet material is spread for cutting and a carriage positioned on one side of the material opposite the bed of the table and which is movable relative to the cutting table in directions generally parallel with sheet material spread on the table. A fluid jet nozzle is mounted on the carriage for movement with the carriage relative to the sheet material and is directed toward the material. Fluid means are connected with the jet nozzle for sending a high velocity cutting jet from the nozzle through the sheet material on the supporting bed between a point at which the jet enters the material and a point at which the jet exits the material. Means are connected to the nozzle for moving the nozzle relative to the sheet material at various speeds including high speeds that cause the point where the jet exits the material to lag behind the point where the jet enters the material. A fluid jet receiver is supported at the one side of the sheet material opposite the nozzle for intercepting the cutting jet exiting the sheet material. The means supporting the receiver permit movement of the receiver generally parallel to the support surface of the table and relative to the material spread on the table. Means are connected to the receiver for moving the receiver relative to the material, and control means are operatively connected to the receiver moving means for maintaining the receiver inlet in registration with the fluid jet exiting the material.

To maintain registration between the receiver inlet and the exiting cutting jet throughout a cutting operation, the control means "knows" to what extent or degree the cutting jet lags the point at which the jet enters the material at any given time during the cutting operation. The control means, including in one embodiment a control computer, calculates the degree of lag from an input of known cutting variables, such variables including the relative speed between the jet nozzle and the material, the cutting resistence of the material, and the thickness of the material layup, and sends command signals to the receiver moving means to position the receiver in alignment with the jet exiting the material.

DETAILED DESCRIPTION OF THE PREFERRED EMBODIMENTS

Figure 1:
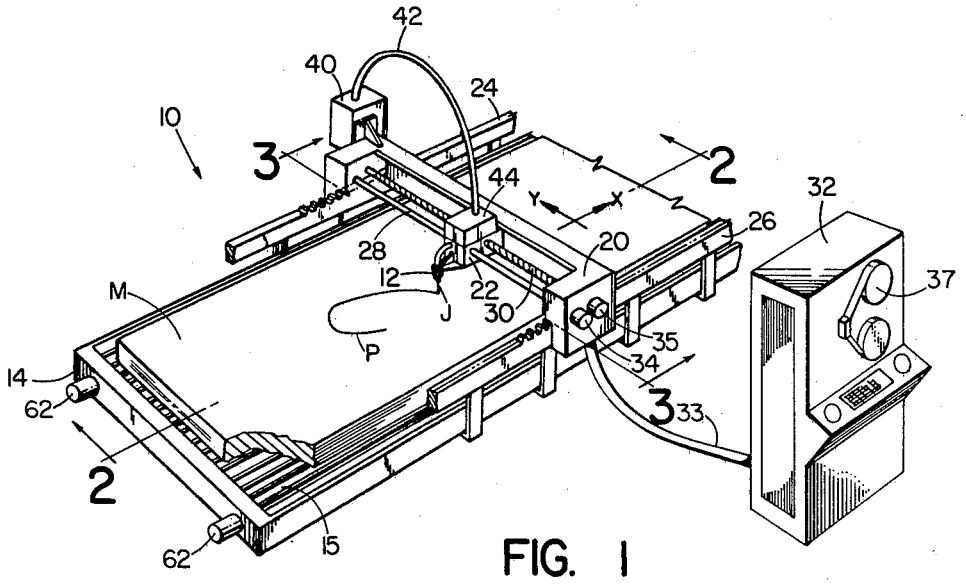
FIG. 1 is a perspective view of a cutting machine incorporating the features of the present invention.

FIG. 1 illustrates a cutting machine, generally designated 10, having a cutting tool in the form of a fluid jet nozzle 12 and a cutting table 14 defining a support surface 15 on which sheet material is spread for cutting. The nozzle produces a high velocity fluid cutting jet J which is directed along an axis from the nozzle through a layup M of sheet material spread on the support surface 15. The illustrated layup M is comprised of limp fabric material such as is used in making upholstery or garments but could also be other types of sheet material including wood, plastics, thin metal foils, paper, leather and similar products. The illustrated machine 10 is a numerically controlled machine connected with a controller 32 by means of an electrical cable 33. The controller 32 takes data from a program tape 37 and converts that data into machine commands for guiding the nozzle 12 along a cutting path P defined by the program tape 37. The cutting path may, for example, be the periphery of a pattern piece forming part of a garment or a panel of upholstery.

The cutting machine 10 includes a carriage mechanism from which the nozzle 12 is supported for movement relative to the table 14 and the sheet material being cut. The carriage mechanism includes an X-carriage 20 which straddles the table and a Y-carriage 22 mounted on the X-carriage. The X-carriage 20 translates back and forth in the illustrated X coordinate direction on a set of racks 24 and 26 which are engaged by an X-drive motor 34 energized by command signals from the controller 32. The Y-carriage 22 is mounted on the X-carriage in the Y coordinate direction and is translated along a guide rail 28 by the Y-drive motor 35 and a lead screw 30 connected between the motor and carriage. Like the drive motor 34, the drive motor 35 is also energized by command signals from the controller 32. Thus coordinated movements of the carriages 20 and 22 translate the nozzle 12 along a cutting path over any area of the table 14.

Fluid for the cutting jet J is delivered from a pump 40 at one side the X-carriage 20 through a flexible conduit 42 to a hydraulic intensifier 44 mounted on the Y-carriage 22. The pump 40 produces an output pressure on the order of 300 psi and that pressure is boosted to the operating pressure of the nozzle 12 in the range of 10,000 psi to 100,000 psi by the intensifier 44. Pumps and hydraulic intensifiers of this type are known in the art. The high pressure fluid then passes through the nozzle 12 having a throat diameter in the range of 0.004 inch to 0.015 inch so that an extremely fine, high velocity fluid jet is directed toward the sheet material M along the jet axis generally perpendicular to the plane of the material and the support table 14.

Figure 2:
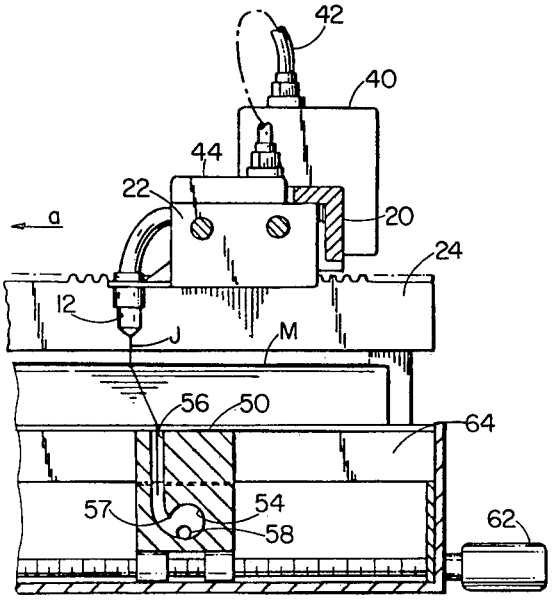
FIG. 2 is a fragmentary cross-sectional view of the cutting machine as viewed along the sectioning line 2—2 of FIG. 1.
Figure 3:
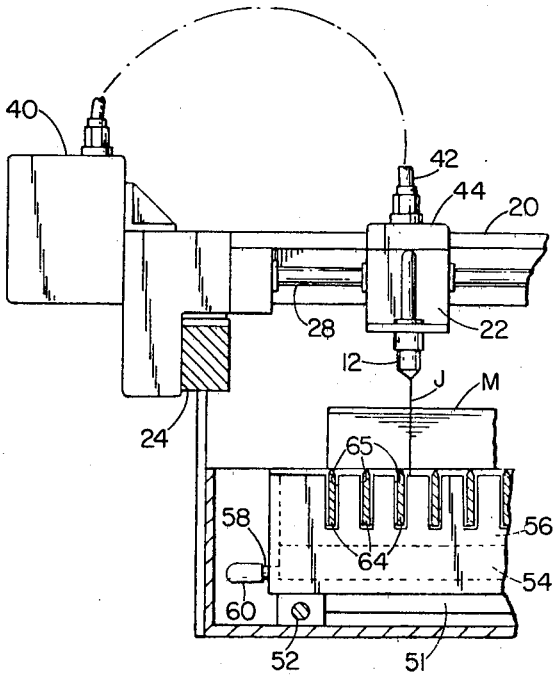
FIG. 3 is a fragmentary cross-sectional view of the cutting machine as viewed along the sectioning line 3—3 of FIG. 1.

As shown in FIGS. 2 and 3, a fluid jet receiver 50 is supported in the cutting machine 10 on the side of the sheet material layup M opposite the jet nozzle 12 in order to intercept the fluid jet J as it exits the sheet material. The receiver 50 extends laterally under the sheet material in the Y coordinate direction and is supportedly overlying a second X-carriage 51 also extending laterally under the sheet material. The second X-carriage 51 is supported at each end by a pair of lead screws 52 (only one visible in FIG. 3) extending along opposite lateral sides of the table 14. The lead screws are directly coupled to synchronously driven drive motors 62 (only one shown in FIG. 2) providing the means by which the jet receiver is moved along the illustrated X-coordinate direction. Like the drive motors 34, 35 controlling the movement of the nozzle 12, the drive motors 62 are also energized by command signals from the controller 32.

The receiver 50 includes a jet-deflection chamber or vortex chamber 54 into which the fluid jet passes and in which the jet is dissipated by being deflected or whirled in circular or helical path. The chamber 54 has a curved or generally cylindrical inner wall with the cylinder axis perpendicular to the jet, and includes an inlet passageway 56 leading into the chamber tangentially over the wall. The length of the cylindrical chamber 54 is the axial direction and the inlet passageway in the Y-coordinate direction are co-extensive with one another and are slightly greater than the excursion of the nozzle 12 and the carriage 22 in the Y-coordinate direction. Therefore, by proper control of the receiver drive motors 62, the inlet 56 may be maintained in registration with the fluid jet exiting the sheet material and the chamber 54 receives the jet for dissipation of its energy at any coordinate location on the table 14 of the cutting machine 10. Thus, as the jet J exits the layup of sheet material M, it is deflected into a generally circular path within the chamber and is whirled around in the chamber against the cylindrical walls until the energy of the jet is dissipated in friction with the walls or other fluid in the chamber.

The chamber 54 also includes a lip 57 in the cylindrical wall at the inner junction with the inlet 56. The lip has a radius of curvature decreasing as the tip of the lip is neared so that the fluid entering the chamber is turned in a smaller and smaller circle as the distance along the wall from the inlet increases. The lip assists in producing a tight, high speed vortex to reduce pressure in the chamber 54 and prevent flow out of the inlet.

The dissipation of power in the jet may create heating which will cause some of the fluid forming the jet, usually water, to vaporize. Also, since the fluid cutting jet J acts as a high powered aspirator, a large quantity of ambient air is drawn by the jet into the chamber and thus, raises chamber pressure. Unless means is provided for evacuating the chamber, the fluid and vapor within the chamber would be forced upwardly into the inlet at locations other than that occupied by the jet. The sheet material M passing over the inlet would thus become wet and saturated with the jet fluid.

To evacuate the chamber and prevent wetting of the sheet material, an evacuation conduit 58 shown most clearly in FIG. 3 is connected to one or both axial ends of the chamber 54 and a flexible evacuation hose 60 feeds from the conduit 58 to a vacuum pump (not shown) for removing from the chamber the spent jet fluid, fluid vapors, aspirated air and suspended solids from the cutting operation. The capacity of the vacuum pump is established to maintain a pressure in the chamber lower than the ambient pressure at the inlet 56. The evacuated fluid may be filtered and recycled through the pump 40 or may simply be disposed of as waste.

The support bed of the table 14 is comprised of a plurality of elongated, relatively rigid and parallel bars 64 that extend from one end of the table to the other in the X-coordinate direction. The upper edges of the bars are sharpened to form knife edges which lie in a common plane and define the support surface 15 of the table on which the sheet material M is spread. The knife edges split an impinging fluid jet without backsplatter that would wet the sheet material. The spacing of the parallel bars is relatively small, for example, not more than a few inches, in order to prevent the sheet material from sagging between the bars as the material rests on the knife edges under its own weight. If desired, thin wires may be laid transversely across the knife edges of the bars to provide additional support for the material.

As illustrated most clearly in FIG. 3, the upper part of the receiver 50 has a plurality of slots 65 which extend through the receiver in the X-coordinate direction and coincide respectively with the plurality of parallel bars 64 passing through the slots. For clarity the slots 65 are shown enlarged; however the bars and slots preferably mate in close-fitting relationship to provide a fluid seal in the regions where the bars intercept the receiver on opposite sides of the inlet 56. As the X-carriage 20 moves over the sheet material in the X-coordinate direction, the bars 64 slide through the respective slots and thus, in effect, the bars are "combed" by the receiver 50. The upper surface of the receiver confronting the bottom of the sheet material layup is preferably spaced slightly below the support plane determined by the knife edges of the bars so that the receiver slides easily beneath the sheet material without disturbing the lower plies.

When the jet J enters the inlet 56 of the receiver, it passes downwardly into the vortex chamber 54 where it is dissipated. If a jet happens to be situated above one of the supporting bars 64, it impinges upon the knife edge and passes into the vortex chamber on one or both sides of the bar. The overlap of the receiver and the bars at either side of the inlet provides a sufficient seal to prevent any spray of the jet from leaving the receiver; however, if a small degree of leakage is observed, an auxiliary drain in the bottom of the cutting table 14 can be provided to remove the spent fluid.

During a cutting operation, the fluid cutting jet J passes through the sheet material layup M between a point on the upper side of the layup at which the jet enters the material and a point on the underside of the layup at which the jet exits the material. Due to the cutting resistance of the layup, the nozzle may be moved at such a translational speed relative to the material that the point at which the jet exits the material lags the point at which the jet enters the material as shown, for example, in FIG. 2 where the nozzle 12 is moving in the direction of the arrow a. The extent or degree of lag is a function of many factors, the more obvious factors including the speed of the nozzle relative to the material, the cutting resistance of each sheet of the material, and the height of the layup. Less obvious lag factors may include direction of cut since the cutting resistance of certain materials may be much different in one coordinate direction than in the other. Examples of such materials possessing direction-dependant cutting resistance include grained woods and open-weave fabrics.

To maintain the receiver inlet 56 in registration with the fluid jet exiting the underside of the sheet material and in accordance with the present invention, unique lag control means are operatively connected to the drive means for moving the receiver relative to the layup. With reference to FIG. 1, the lag control means is incorporated in the controller 32 connected to the cutting machine 10 and develops lagging command signals which are sent through the electrical cable 33 to the drive motors 62 for moving the receiver. Upon receiving the command signals, the drive motors 62 position the receiver accordingly.

Figure 4:
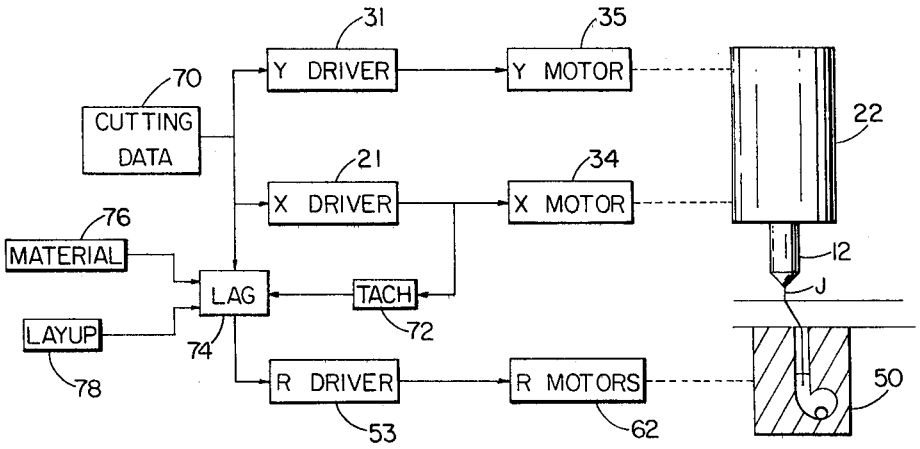
FIG. 4 is a schematic illustration of the controls in the cutting machine of FIG. 1.

The schematic of FIG. 4 illustrates the the nozzle and receiver positioning controls of the cutting machine. From the cutting data 70, stored on magnetic tape 37, the controller generates and sends position command signals to X- and Y- drive motors 34 and 35 by way of power amplifiers or X- and Y- drivers 21 and 31, respectively, supported in the table for moving the nozzle 12 relative to the material. The tachometer 72 senses the X-coordinate speed of the nozzle and sends a signal corresponding to that speed to a lag computing center 74. Since the receiver inlet 56 is elongated in the Y-coordinate direction and will intercept any Y-coordinate contribution of the lag as long as the X-coordinate position of the receiver inlet aligns with the exiting jet, the speed of the Y-motor 35 is irrelevant to the lag computation. At the lag computing center 74, the sensed speed of the X-motor 34 is factored with relevant material resistance input 76, such as the aforementioned cutting resistance factor of each individual sheet of material and layup height input 78, and the present location of the X-carriage along the table to generate a receiver-positioning command signal. The generated positioning signal is then sent to the receiver drive motors 62 by way of a power amplifier, or receiver driver 53, for positioning the receiver inlet accordingly.

In summary, the fluid jet cutting machine including a receiver mounted mechanically independent of the nozzle mounting means and a control means which controls the position of the receiver so that the receiver intercepts a lagging fluid jet exiting the material to be cut has herein been disclosed in a single embodiment. However, numerous modifications and substitutions may be had in the disclosed embodiment without departing from the spirit of the invention. For example, it is recognized that a receiver for the cutting jet may have an inlet which is elongated in the X-coordinate direction, rather than in the Y-coordinate direction as described in the FIG. 1 cutting machine, and mounted for movement by suitable drive means in the Y-coordinate direction. With such a receiver in the cutting machine, the lag computing center factors the speed of the Y-coordinate moving means of the nozzle (indicated at 35 in FIG. 1) instead of the X-coordinate nozzle moving means. Accordingly, the present invention has been described by way of illustration rather than limitation.

I claim:

1. An apparatus for cutting sheet material with a fluid jet comprising:

a cutting table having a bed defining a support surface extending in two coordinate directions for holding sheet material in a spread condition for cutting;

a carriage positioned on one side of the sheet material opposite the support surface and movable in the two coordinate directions relative to the sheet material spread on the surface of the table;

a fluid jet nozzle mounted on the carriage for movement with the carriage relative to the sheet material in the two coordinate directions and directed toward the material on the support surface;

fluid means connected with the jet nozzle for supplying pressurized fluid to the nozzle and sending a high velocity cutting jet from the nozzle through the sheet material on the support surface between a point at which the jet enters the material and a point at which the jet exits the material;

means connected to the nozzle for moving the nozzle relative to the sheet material in the two coordinate directions at various translational speeds;

a fluid jet receiver for intercepting the cutting jet exiting the sheet material and defining an inlet for the jet;

means for supporting the fluid jet receiver at the one side of the sheet material opposite the nozzle for movement of the receiver generally parallel to the support surface of the table and relative to the material in at least one of the two coordinate directions;

means connected to the receiver for moving the receiver relative to the material in at least said one of the two coordinate directions and independently of the means for moving the nozzle in the same one of the two coordinate directions; and control means operatively connected to the receiver moving means for variably positioning the receiver inlet relative to the nozzle to maintain the receiver inlet in registration with the fluid jet exiting the material at a position behind the nozzle in the direction of movement in at least said one of the two coordinate directions while the nozzle is moved relative to the sheet material at various translational speeds, which cause the point where the jet exits the material to lag by varying amounts behind the point where the jet enters the material.

2. An apparatus for cutting sheet material as defined in claim 1 wherein the means for moving the nozzle is a first drive motor and the means for moving the receiver is a second drive motor.

3. An apparatus for cutting sheet material as defined in claim 1 wherein the means for supporting the fluid jet receiver includes a second carriage positioned on said one side of the material opposite the nozzle and movable relative to the cutting table and parallel with the sheet material spread on the support surface of the bed.

4. An apparatus for cutting sheet material as defined in claim 3 wherein the second carriage is movable in one or two coordinate directions parallel to the support surface, and the inlet of the fluid jet receiver is elongated in the other of the two coordinate directions to receive the jet at a plurality of stations along the other coordinate.

5. An apparatus for cutting sheet material as defined in claim 4 wherein the fluid jet receiver has a plurality of slots extending through the receiver in the one coordinate direction, and the bed of the cutting table is comprised of a corresponding plurality of bars extending in the one coordinate direction through the slots of the receiver and having exposed edges in a common plane defining the support surface of the table bed.

6. In a cutting machine having a cutting tool including a jet nozzle having a jet axis directed toward a support surface on which sheet material is spread to be cut by a high velocity fluid cutting jet issuing from the nozzle and passing along the axis toward the material, the nozzle being mounted on a tool carriage for movement generally parallel to the support surface and the material supported on the surface, means for moving the nozzle relative to the material so that the exit point at which the cutting jet exits the material lags the entry point at which the cutting jet enters the material, a fluid jet receiver positionable to intercept the fluid cutting jet exiting the material on the support surface, the receiver including a jet deflection chamber having a curved inner wall and an inlet leading into the interior of the deflection chamber tangentially of the curved inner wall, the improvement comprising:

means supporting the fluid jet receiver independently of the tool carriage for movement of the receiver relative to the material generally parallel to the support surface and the material supported on the surface, means for moving the receiver relative to the material, and control means connected with the nozzle moving means and the receiver moving means for variably positioning the receiver inlet relative to the nozzle to maintain registration of the receiver inlet and the fluid jet exiting the material as the relative positioning of the entry and exit points varies.

* * * * *